United States Patent [19]

Hotz

[11] 4,406,039

[45] Sep. 27, 1983

[54] DEVICE FOR CLEANING THE ROLLS OF DRAFT ROLLING MILLS OF TEXTILE MACHINES

[76] Inventor: Hans R. Hotz, Via Per Stabio, CH-6853 Ligornetto, Switzerland

[21] Appl. No.: 289,648

[22] Filed: Aug. 3, 1981

[30] Foreign Application Priority Data

Aug. 4, 1980 [IT] Italy ..... 53458/80[U]

[51] Int. Cl.[3] ..... G03G 15/00; D01H 5/60

[52] U.S. Cl. ..... 19/262; 15/256.51

[58] Field of Search ..... 19/262, 263, 264, 265, 19/245; 15/256.51; 355/15; 118/261

[56] References Cited

U.S. PATENT DOCUMENTS

| | | | |
|---|---|---|---|
| 3,101,504 | 8/1963 | Gasser | 19/262 X |
| 3,660,863 | 5/1972 | Gerbasi | 15/256.51 X |
| 4,152,067 | 5/1979 | Kubota | 355/15 |
| 4,255,044 | 3/1981 | Cormier et al. | 15/256.51 X |

FOREIGN PATENT DOCUMENTS

| | | | |
|---|---|---|---|
| 1079513 | 4/1960 | Fed. Rep. of Germany | 19/264 |
| 862515 | 12/1940 | France | 15/256.51 |
| 978988 | 1/1965 | United Kingdom | 15/256.51 |
| 2018848 | 10/1979 | United Kingdom | 15/256.51 |

*Primary Examiner*—Louis Rimrodt

*Attorney, Agent, or Firm*—Sughrue, Mion, Zinn, Macpeak and Seas

[57] ABSTRACT

A device for cleaning the rolls of draft rolling mills of textile machines includes a support bar arranged parallel to the axis of the roll, and a cleaning fillet of resiliently deformable material carried by the support bar and having a longitudinal lip in pressure contact with the circumferential surface of the roll. The cleaning fillet has a longitudinal stiffening reinforcement in the zone adjacent the contact with the roll.

3 Claims, 1 Drawing Figure

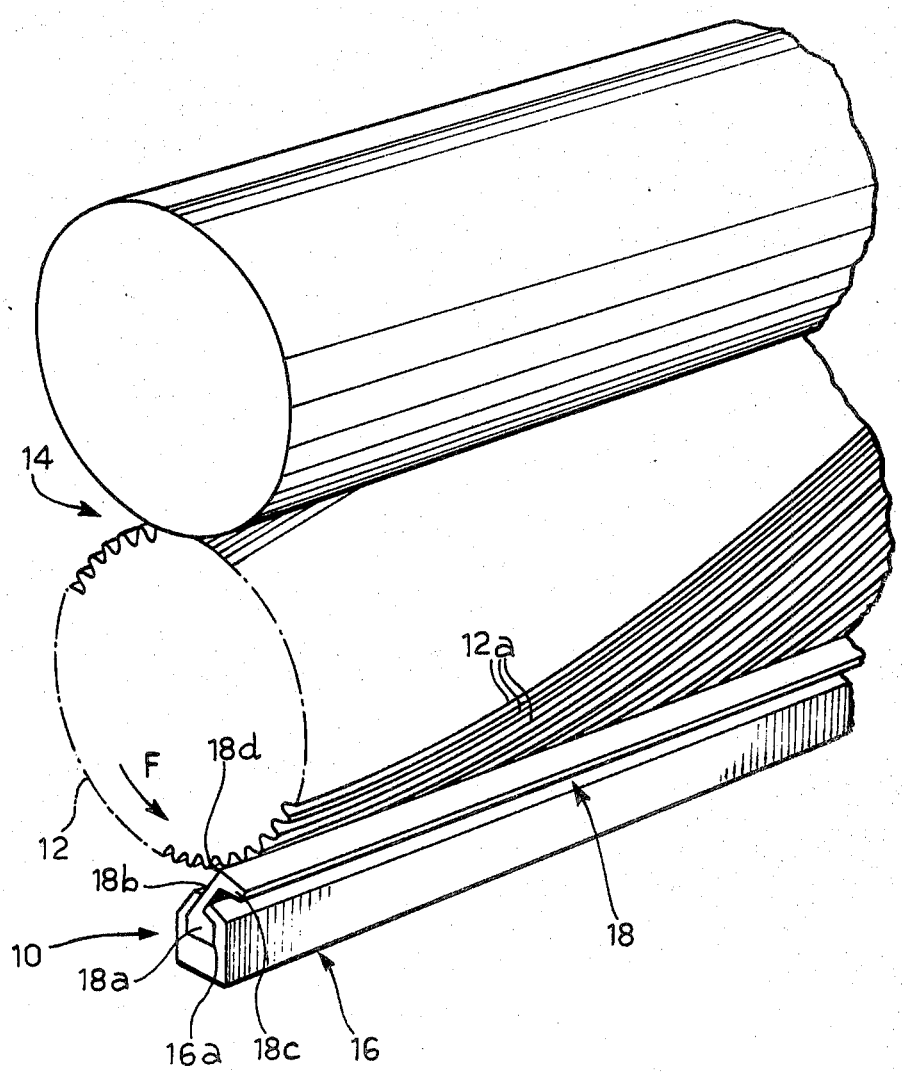
14
12a
F
18d
12
18b
10
18a
16a
18c
16
18

DEVICE FOR CLEANING THE ROLLS OF DRAFT ROLLING MILLS OF TEXTILE MACHINES

The present invention relates generally to the rolls of draft rolling mills of textile machines. More particularly, the invention relates to a cleaning device for preventing the formation of swathes of textile fibres on the circumference of the rolls of the rolling mill, of the type including a rigid support bar arranged parallel to the axis of the roll, and a cleaning fillet of resiliently deformable material carried by the support bar and having a longitudinal angled lip in pressure contact with the circumferential surface of the roll.

It is known that cleaning devices of the aforesaid type have a considerably better performance than cleaning devices with "tube"-type cleaning fillets, and those presently in use have an elastomeric cleaning fillet with a portion fixed permanently to the support bar, and a portion which projects from the support bar towards the surface of the roll at a predetermined inclination and is provided with the contact lip. This projecting part is tapered towards its free edge, thus having a smaller thickness at the contact lip than at the root portion fixed to the support bar. This shape has the disadvantage that the cleaning fillet is subjected to rapid wear and, after a relatively short period of use, its contact lip becomes cracked and broken.

It has been established that this breaking and cracking is due mainly to the fatigue stresses to which the cleaning fillet is subjected. Essentially, these stresses are due to the passage of successive helical ridges, with which the roll is normally provided, over the contact lip of the fillet during rotation of the roll.

At the passage of each successive ridge, a wave of deformation is generated along the contact lip due to the ridge squashing successive zones of the lip which, given the shape of the fillet, returns elastically to its undeformed condition immediately upstream and immediately downstream of the zone of contact with the ridge.

The lip is thus subjected to a high intensity deformation wave which, depending on the rotational speed of the roll, is repeated with a frequency of the order of 70,000 times per minute, causing rapid break-down of the elastomeric material by fatigue.

Delicate and costly apparatus for advancing the cleaning device is therefore necessary to compensate for the wear on the lip and to maintain it in contact with the roll. In every case, frequent replacement of the entire cleaning device is essential, with obvious financial wastage.

The object of the present invention is to avoid these disadvantages and hence provide a cleaning device of the aforesaid type which behaves better in operation and has a longer working life than conventional cleaning devices.

In order to achieve this object, the present invention provides a device for cleaning the rolls of draft rolling mills of textile machines, of the type defined initially, the main characteristic of which lies in the fact that the cleaning fillet of resiliently deformable material has a longitudinal stiffening reinforcement in the zone adjacent the lip in contact with the roll.

This solution allows a considerable increase in the fatigue strength of the cleaning fillet, and hence prolongs its working life. In fact, the presence of the stiffening reinforcement prevents the immediate elastic return of the contact lip immediately upstream and immediately downstream of the zone of contact with the successive ridges of the roll, thus reducing the degree of local deformation of the elastomeric material. In effect, these deformations which, in conventional cleaning devices are very concentrated, are distributed over a greater length of the contact lip, in this case. This allows the use of a softer material which is more elastic and hence has a greater fatigue strength, for the same contact pressure against the surface of the roll.

According to the invention, the stiffening reinforcement consists of enlargement in the form of a rib formed integrally with the cleaning fillet and arranged parallel to the lip in contact with the roll.

This solution has the advantage of being particularly simple and economic. Alternatively, this stiffening reinforcement could, however, consist of a rigid element incorporated in the cleaning fillet close to the contact lip.

While the shape of the cleaning fillet in conventional cleaning devices makes it necessary to fix it permanently to the support bar in order to avoid undesired deflections and undulations, which would make the action of the contact lip ineffective, in the device according to the invention the necessary rigidity and stability of the cleaning fillet is ensured by the presence of the longitudinal stiffening reinforcement. Thus, the cleaning fillet may be releasably connected to the support bar. This results in a significant reduction in the manufacturing costs, since it is possible to avoid vulcanising the cleaning fillet to the support bar, and in the working costs, due to the fact that the simple replacement of the cleaning fillet suffices at the end of its working life, the support bar being preserved.

Furthermore, with this method, it is possible to eliminate the complex advancing mechanisms used in the conventional cleaning devices to maintain the constant contact pressure between the lip of the fillet and the surface of the roll, since it is much more convenient from an economic point of view to re-attain the contact pressure by replacing the cleaning fillet.

According to the invention, the cleaning fillet has a shaped root portion inserted in a cooperatingly-shaped groove, with a complementary profile, in the support bar.

This characteristic allows the replacement of the cleaning fillet to be simplified and made noticeably easier.

The invention will now be described with reference to the appended drawing which, being provided purely by way of non-limiting example, is a schematic perspective view of a cleaning device according to the invention.

With reference to the drawing, the cleaning device according to the invention, generally indicated 10, is applied to the drawing roll 12 of a draft rolling mill 14 of a textile machine, for example, a drawing frame. The drawing roll 12 has a series of parallel helical grooves 12*a* on its circumferential surface.

The cleaning device 10 consists essentially of a metal support bar 16 arranged parallel to the axis of the roll 12, and a cleaning fillet 18 of elastomeric material carried releasably by the bar 16 and extending along the entire length of the bar 16.

The cleaning fillet 18 has a substantially C-shaped cross-section and includes a thickened root portion 18*a* connected to the bar 16, a middle part 18*b* of substantially constant thickness projecting outwardly from the bar 16 and inclined at a predetermined angle to the surface of the roll 12, and a longitudinal extending reinforcing part in the form of a rib 18*c* formed integrally with the fillet 18 and projecting downwardly. The longitudinally extending reinforcing rib is disposed parallel to the longitudinally extending lip.

The middle part 18*b* and the reinforcing rib 18*c* are connected externally so as to define an angled longitudinal active lip 18*d* which is pressed into contact with the surface of the roll 12 at a predetermined pressure.

The releasable connection of the cleaning fillet 18 to the bar 16 is achieved by the engagement of the root portion 18*a* in a corresponding groove 16*a* of complementary section which is formed in the bar 16. Thus, the fillet 18 may be slid easily and rapidly out of the groove longitudinally of the bar 16, so as to allow it to be replaced at the end of its working life.

In use, as a result of the rotation of the drawing roll 12 in the sense indicated by the arrow F, the contact 18*d* of the cleaning fillet 18 sweeps the surface of the roll 12, preventing the formation of undesirable swathes of the textile fibres fed to the rolling mill 14 around the roll 12. The shape of the fillet 18 and, in particular, the presence of the longitudinal stiffening rib 18*c*, allows the concentration of local deformations of the contact lip 18*d* to be significantly reduced, consequently increasing its fatigue strength.

This allows the use of a relatively soft, and hence more efficient, elastomeric material for the fillet 18. Furthermore, the presence of the stiffening rib 18*c* ensures the necessary rigidity and stability of the fillet 18, rendering its permanent fixing to the metal support bar 16 by vulcanisation superfluous, with obvious reductions in the production and maintenance cost of the device.

Rather than the integral rib 18*c*, the stiffening reinforcement of the fillet 18 may be achieved by other equivalent means, such as a longitudinal metal insert in the fillet 18 adjacent the contact lip 18*d*, or an elastomeric part of greater rigidity incorporated in the fillet 18 in the same zone.

Even the releasable connection between the fillet 18 and the bar 16 may be achieved in a different manner from that illustrated by, for example, a gripper member carried by the bar 16 and adapted to ensure a rapid replacement of the fillet 18.

Naturally, the scope of the present invention applies to embodiments which achieve the result by using the same inventive concept.

I claim:

1. Device for cleaning the rolls of draft rolling mills of textile machines, including a support bar arranged parallel to the axis of the roll, and a resiliently-deformable cleaning fillet carried by the support bar, said fillet having a longitudinally extending angled lip in pressure contact with the circumferential surface of the roll, wherein the improvement consists in said cleaning fillet having a longitudinal stiffening reinforcement in correspondence with the zone adjacent the contact lip and composed of a longitudinally extending reinforcing rib formed integrally with the cleaning fillet and extending parallel to the longitudinally extending contact lip.

2. Device as defined in claim 1, wherein the cleaning fillet is releasably connected to the support bar.

3. Device as defined in claim 2, wherein the cleaning fillet has a shaped root portion, and the support has a groove with a profile complementary to the root portion in which the lattr is inserted.

* * * * *